US010350934B2

(12) United States Patent
Renz et al.

(10) Patent No.: US 10,350,934 B2
(45) Date of Patent: Jul. 16, 2019

(54) APPARATUSES AND METHODS FOR OPTICALLY VARIABLE PRINTING

(71) Applicant: Illinois Tool Works Inc., Glenview, IL (US)

(72) Inventors: Robert Phillip Renz, Ipswich (GB); Morven McAlpine, Ipswich (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/639,493

(22) Filed: Jun. 30, 2017

(65) Prior Publication Data

US 2018/0079251 A1 Mar. 22, 2018

Related U.S. Application Data

(60) Provisional application No. 62/395,894, filed on Sep. 16, 2016.

(51) Int. Cl.

| | |
|---|---|
| ***B41M 3/14*** | (2006.01) |
| ***B42D 25/373*** | (2014.01) |
| ***B42D 25/328*** | (2014.01) |
| ***B42D 25/378*** | (2014.01) |
| ***B42D 25/41*** | (2014.01) |
| ***B41F 11/02*** | (2006.01) |
| ***B41F 16/00*** | (2006.01) |

(Continued)

(52) U.S. Cl.

CPC ..... *B42D 25/373* (2014.10); *B41F 11/02* (2013.01); *B41F 16/0046* (2013.01); *B41M 3/008* (2013.01); *B41M 5/385* (2013.01); *B41M 5/38235* (2013.01); *B42D 25/309* (2014.10); *B42D 25/328* (2014.10); *B42D 25/351* (2014.10); *B42D 25/378* (2014.10); *B42D 25/41* (2014.10); *B41M 3/148* (2013.01)

(58) Field of Classification Search

CPC ..... B41M 1/18; B41M 1/22; B41M 3/144; B41M 3/148; B41M 2205/02; B41M 2205/06; B41M 2205/38; B41M 2205/40; B41M 2205/42; B41M 3/14; B42D 25/309; B42D 25/318; B42D 25/351; B42D 25/405; B42D 25/505

USPC ..... 283/114, 901, 77, 94, 107–109, 112; 428/32.75, 32.77, 32.8; 503/227

See application file for complete search history.

(56) References Cited

U.S. PATENT DOCUMENTS

| | | | |
|---|---|---|---|
| 5,248,544 | A | 9/1993 | Kaule |
| 5,648,165 | A | 7/1997 | Phillips et al. |

(Continued)

FOREIGN PATENT DOCUMENTS

| | | | |
|---|---|---|---|
| EP | 1390211 | A1 | 2/2004 |
| WO | 0166360 | A1 | 9/2001 |

OTHER PUBLICATIONS

International Search Report and Written Opinion for co-pending international application No. PCT/US2017/51529, report dated Feb. 12, 2018 (22 pages).

(Continued)

*Primary Examiner* — Gerard Higgins

(74) *Attorney, Agent, or Firm* — Joseph F. Harding; The Small Patent Law Group LLC

(57) ABSTRACT

A method is provided for printing to a target. The method includes printing a first image to the target. The first image is printed with a metallic material. The method also includes printing a second image to the target over the first image. The second image is printed with a colored semi-transparent material.

20 Claims, 2 Drawing Sheets

(51) Int. Cl.

| | |
|---|---|
| ***B41M 5/382*** | (2006.01) |
| ***B41M 3/00*** | (2006.01) |
| ***B41M 5/385*** | (2006.01) |
| ***B42D 25/309*** | (2014.01) |
| ***B42D 25/351*** | (2014.01) |

(56) References Cited

U.S. PATENT DOCUMENTS

| | | | |
|---|---|---|---|
| 6,107,244 | A | 8/2000 | Zeira et al. |
| 6,521,036 | B1 | 2/2003 | Bleikolm et al. |
| 6,686,042 | B1 | 2/2004 | LeGallee et al. |
| 6,695,905 | B2 | 2/2004 | Rozumek et al. |
| 7,544,266 | B2 | 6/2009 | Herring et al. |
| 2004/0013141 | A1 | 1/2004 | Suzuki |
| 2010/0209677 | A1 | 8/2010 | Sano et al. |
| 2011/0226147 | A1 | 9/2011 | Trantoul et al. |

OTHER PUBLICATIONS

Search Report and Written Opinion for copending international application No. PCT/US2017/51529, report dated Dec. 18, 2017 (16 pages).

International Preliminary Report on Patentability for co-pending international application No. PCT/US2017/051529, Report dated Mar. 19, 2019 (14 pages).

APPARATUSES AND METHODS FOR OPTICALLY VARIABLE PRINTING

RELATED APPLICATIONS

The present application claims priority to U.S. Provisional Application Ser. No. 62/395,894, entitled "Apparatuses and Methods for Optically Variable Printing," filed Sep. 16, 2016, the subject matter of which is hereby incorporated in its entirety.

FIELD

Embodiments of the present disclosure generally relate to optically variable printing, for example printing of images that change shade of color and/or displayed content corresponding to a change in viewing or lighting angle.

BACKGROUND OF THE DISCLOSURE

Optically variable features may be utilized for security and/or decorative purposes. For example, security features may be printed to a document. Level 1 security features may be understood as features that may be authenticated without the need for extra equipment, whereas level 2 or level 3 features may include additional or specialist equipment for verification. Level 1 security features may be provided, for example, via a visual and/or tactile effect. Level 1 security features may be provided with optically variable features, or features that change in appearance upon movement and/or viewing angle of a document. For example, holographic features may be employed, or, as another example, optically variable color shifting pigments may be utilized.

Thermal transfer printing may be used to print documents such as identification cards. Various pigments may be used as part of a thermal transfer printing process. For example, optically variable pigments may be used to provide optically variable features; however, optically variable pigments have several drawbacks. For example, optically variable pigments tend to be expensive, which renders thermal transfer ribbons utilizing optically variable pigments expensive. Further, thermal transfer ribbons may be manufactured by a gravure printing process, and optically variable pigments may have drawbacks in connection with such manufacture of thermal printing ribbons.

For example, the production of thermal transfer ribbons may utilize a pigment/polymer formulation that is applied onto a polyester film via a process such as direct gravure printing using an etched gravure cylinder. Various additive or additional polymers may be added to the formulation to assist with coating, printing, or durability performance. Generally, this production requires pigments that may be easily or conveniently suspended in a polymer solution having a coatable viscosity, and that may transfer from the cells of the gravure cylinder without blocking. However, optically variable pigments generally are of larger size, are plate-like in shape (i.e., having one dimension significantly larger than another dimension), and are of relatively high density. These attributes render optically variable pigments inappropriate or inconvenient for gravure printing. Further, difficulty in controlling the orientation of the plate-like materials renders their use difficult to control with gravure and/or thermal printing processes.

SUMMARY OF THE DISCLOSURE

Certain embodiments of the present disclosure provide materials capable of producing an optically variable feature.

The materials include a metallic material and a separate semi-transparent colored material that may be provided image-wise in the same areas of a substrate to produce an optically variable feature. As used herein, a semi-transparent colored material is a colored material having sufficient transparency to provide the optically variable effect in cooperation with a metallic material as discussed herein.

Certain embodiments of the present disclosure provide a method for printing to a target. The method includes printing a first image to the target. The first image is printed with a metallic material. The method also includes printing a second image to the target over the first image. The second image is printed with a colored semi-transparent material.

Certain embodiments of the present disclosure provide a thermal transfer sheet for printing to a target. The thermal transfer sheet includes a substrate, a metallic mass transfer panel, and a colored semi-transparent pigment mass transfer panel. It may be noted that in some embodiments, a colored semi-transparent pigment mass transfer sheet may be configured as a panel, while in other embodiments, the optically variable feature may be produced with the use of two continuous format thermal transfer sheets (e.g., a colored semi-transparent sheet and a metallic sheet). The metallic material mass transfer panel is disposed above the substrate. The colored semi-transparent pigment mass transfer panel is also disposed above the substrate. The metallic material mass transfer panel and the colored semi-transparent pigment mass transfer panel are positioned in the thermal transfer sheet such that the thermal transfer sheet prints onto the target in the following order: first, to print from the metallic material mass transfer panel; next, to print from the colored semi-transparent pigment mass transfer panel.

Certain embodiments of the present disclosure provide a document that includes a base, a first image, and a second image. The first image is printed on the base and includes a metallic material. The second image is printed on the base. The first image is interposed between the base and the second image. The second image includes a colored semi-transparent pigment.

Certain embodiments of the present disclosure provide a document body that includes a base, a first image layer, and a second image layer. The first image is provided on the first layer and includes a metallic material. The second image is provided on a separate layer. The first image layer is interposed between the base and the second image layer. The second image includes a colored semi-transparent pigment. The base, and first and second layers are laminated together to form a document body.

DETAILED DESCRIPTION OF THE DISCLOSURE

Figure 1:
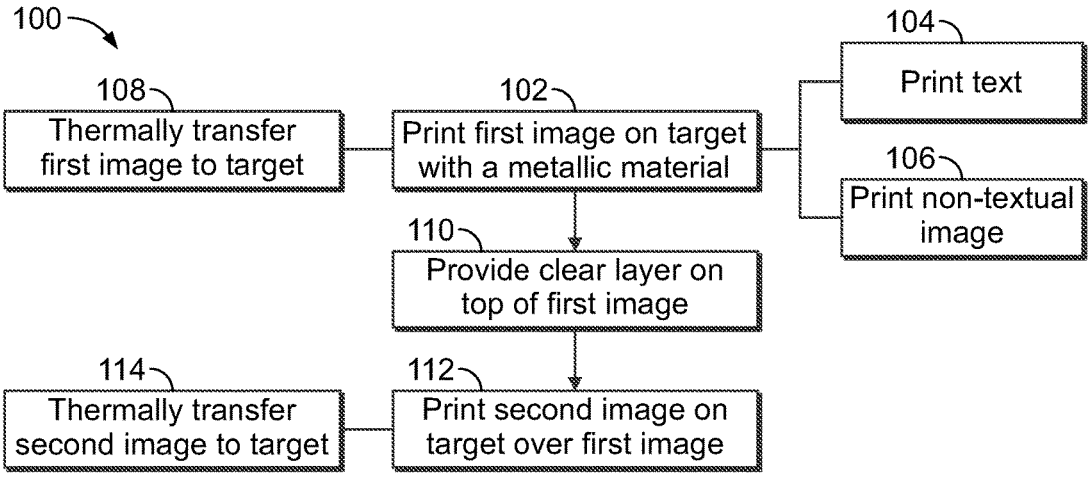
FIG. 1 provides a flowchart of a method according to an embodiment of the present disclosure.

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Various embodiments will be better understood when read in conjunction with the appended drawings. To the extent that the figures illustrate diagrams of the functional blocks of various embodiments, the functional blocks are not necessarily indicative of the division between physical components. Thus, for example, one or more of the functional blocks may be implemented in a single component or unit or multiple components or units. Similarly, a given block may be implemented using two or more distinct physical components. It should be understood that the various embodiments are not limited to the arrangements and instrumentality shown in the drawings.

Various embodiments provide, for example, methods or techniques for providing optically variable features on printed media, for example a personalized or customized optically variable printed feature. Optically variable features are provided without using relatively large or expensive optically variable pigments. Various embodiments provide separate images and/or layers which are not optically variable individually but instead cooperate to provide an optically variable effect. For example, a combination of two different types of pigments (e.g., a first type of pigment that is metallic and a second type of pigment which is colored and semi-transparent) which are coated or printed to a target may be used to provide an optically variable effect. Various embodiments provide point of issuance, personalized, optically variable features to security cards and documents. It may be noted that, in some embodiments, optically variable features may be provided that are not personalized but instead are general or shared by a group of cards or other documents.

Metal flake pigments may be utilized in various embodiments. It may be noted that metal flake pigments may be characterized as being one of two types: leafing, and non-leafing. Leafing pigments, for example, tend to orient at or near a film surface parallel to each other and/or float to the top of a coating to provide a generally continuous metallic flake barrier and surface that reflects light in a relatively highly specular manner, and/or provides a relatively high luster or brilliance. Non-leafing pigments tend to distribute more evenly throughout a film, providing an appearance of a metallic grain or patina, with less luster or brilliance than leafing pigments. Both leafing and non-leafing pigments may be mixed with a binder polymer to allow mass transfer printable coating. Generally, in various embodiments, a combination of luster and good adhesion characteristics provide effective visual effects. Either aqueous or solvent based systems may be used, for example. Suitable binders may be selected from a range of polymer types including but not limited to polyesters, acrylics, polyurethanes, or the like. In some embodiments, additives may be added to a pigment/binder combination to improve one or more of adhesion, durability, or print definition, among others. Additionally, or alternatively, additives may be added to improve processability. For example, additives such as viscosity modifiers or wetting agents may be employed.

Various colored pigments (e.g., colored semi-transparent pigments) may be used in different embodiments. Organic or inorganic pigments may be employed. Pigments may be provided as solids or as a pre-dispersion in a solvent, for example. In various embodiments, additional dispersants or polymeric binders may be added to maintain a good dispersion. Use of pre-dispersions provides simplicity in the solution preparations stage, but may have increased transportation costs. Use of pigments in solid form reduces transportation costs and related issues, but results in dispersion and solution preparation steps during manufacturing. Generally, to achieve sufficient transparency of a coating created with a pigment material, the particle size and size distribution may be controlled. As used herein, a semi-transparent colored material is a colored material having sufficient transparency to provide the optically variable effect when used in cooperation with a metallic material as discussed herein. For example, use of pigment having sub-micron particle size provides sufficient transparency in various embodiments. It may be noted that, in various embodiments, a sub-micron particle size may be provided even if some particles exceed a micron particle size (e.g., due to a size distribution among all the particles). For example, if an average or mean particle size is sub-micron, and relatively few of the particles exceed a micron, the mixture may be understood as having a sub-micron particle size. Generally, in various embodiments, the sizes of the individual particles of colored pigment, as a group, are small enough to provide sufficient transparency to provide an optically variable effect when used in connection with a metallic material as discussed herein. It may be noted that, in some embodiments, for example, particles sized between about 0.09 microns and 0.47 microns may provide the color shift or visual effect discussed herein. It may further be noted that size of the semi-transparent colored material particles is not the only determining factor in terms of providing the color shift or visual effect in combination with a metallic material. For example, certain particles sized between about 1.3 and 1.9 microns may not provide the colored shift, while particles sized, for example, about 2.6 microns may provide a weakly visible color shift or visual effect. Further, generally smaller particles sizes may be used to provide better print definition. While other factors may also affect print definition, use of particles sized below one micron in general tends to produce improved print definition.

Use of a small particle size (e.g., sub-micron) along with a narrowly defined range of particle size is useful for maintaining good print definition and providing a sufficient level of transparency. It has been surprisingly found by the present inventors that, through appropriate selection of materials and production of a thermally transferable material containing sufficiently small pigments, a level of transparency may be achieved that, when printed in an image-wise fashion on top of an image printed with a thermally transferable material containing a leafing silver pigment, provides an optically variable effect, with the colors of the first printed image and second printed image changing (e.g., from light to dark). For example, the first printed image and second printed image may change oppositely—at a first viewing angle, the first printed image appears darker and the second printed image lighter, but at a second viewing angle the first image appears lighter and the second image darker.

It may be noted that the leafing silver pigment discussed above refers to color and not necessarily material, for example a leafing aluminum material may be used to provide the leafing silver pigment. Also, as used herein, color may refer to the visual appearance of the material, such that the term color change may refer to a variance of shade (e.g., from light blue to dark blue) and not necessarily a change of color. It may be noted that, in various embodiments, additional mass transfer and/or dye diffusion panels may be used, addition to mass transfer panels for a metallic pigment and a colored semi-transparent pigment, for example to print a color photograph and/or a barcode, among other things. In various embodiments, additional colors may be used, a transparent colorless adhesive layer may be printed between the metallic and colored semi-transparent images, and/or a protective coating may be printed over the metallic and/or colored semi-transparent images.

It may be noted that optical variability or visual effects in various embodiments is not limited to a light/dark transition. For example, through selective dithering of two different images, and first printing one image with a metallic material and subsequently printing a second image with colored semi-transparent material as discussed herein in the same area of the substrate as the first image, an optically variable effect may be achieved. Specifically, one of the images may be visible at all viewing angles, while the other image cannot be seen at certain viewing angles but then becomes clearly visible at different viewing angles. For example, one image may be hidden within the other image until the printed article is viewed at the appropriate angle. As another example, one image may be seen as either in front of or behind the other image depending on the angle of view. For instance, in some embodiments, an image of a face may appear behind text or in front of text, depending on the viewing angle.

Binder and pigment materials may be selected to provide good adhesion both to a substrate being printed on and to any layers below or above. In various embodiments, co-binder, additional polymers, and/or additional additives may assist with achieving a desired adhesion balance. Additional colorless and transparent layers may be employed to adhere to the substrate or as an interposing layer.

In some embodiments, the substrate which is printed upon may be PVC or PC, for example for ID documents. Other substrate materials may be used in other embodiments. For example, Teslin materials, security papers, or coated receivers such as polyesters may be used. In various embodiments, protective top coats or layers may be coated or adhered to target to help protect an image. By way of example and not limitation, such protective layers or top coats may be in the form of polyester thin film coatings, PVC, PC, acrylic, patches (holographic or clear), or UV curable materials (which may be cured before or after application on to an image).

It may be noted that embodiments of the present disclosure utilize a combination of an image printed with a metallic material and an image printed with a colored semi-transparent material, neither of which provide an optically variable effect on their own, to create an optically variable effect. However, when combined (e.g., an image printed with colored semi-transparent material printed on top of an image printed with metallic material), an optically variable effect is provided. Various embodiments utilize highly reflective metallic pigments and colored sub-micron pigments that partially absorb, transmit, and scatter light providing a substantially transparent colored image that provides visually different color and/or content depending on angle of view. Both the metallic pigment and the colored sub-micron (or otherwise semi-transparent) pigment may be printed image-wise, enabling unique personalized features in one or both of the corresponding images to be formed at a point of issuance.

It may be noted that non-transparent colored pigments used in combination with metallic pigments may provide a colored area with a metallic-type luster, but one skilled in the art would recognize that the optically variable effect(s) discussed herein would not be replicated to the extent provided by semi-transparent colored pigments. Embodiments disclosed herein not only protect against counterfeiting by preventing effective photocopying (as a photocopy would not have the optically variable effect(s)), but also provide for the use of different combination of colors, as the color itself originates from the colored pigments, of which there is a large variety to choose from. Further, because embodiments disclosed herein utilize a combination of materials instead of single source of iridescent pigment, the supply of the individual components may be separated and controlled such that having only one of the materials does not allow for replication of the optically variable feature(s). Various embodiments, through the use of colored semi-transparent pigments in conjunction with metallic pigments, for example, avoid the use of expensive, large, dense pigments which may also introduce difficulties into manufacture.

While various embodiments employ thermal transfer printing (e.g., to enable personalization of a document), other techniques may be employed. When thermal transfer printing is employed, in some embodiments a protective top coat may be applied after the thermal transfer printing is employed.

It may be noted that in various embodiments, a security feature (e.g., an optically variable feature) may be included within the body of a security card or document. For example, the metallic pigment and colored semi-transparent pigment in various embodiments are applied by an alternative printing technique (i.e., other than TTR) to a plastic sheet or roll that is then later incorporated into the body of the card or document. One example technique that may be used is hot stamp transfer followed by plate lamination, which may be used in the production of polycarbonate cards. The metallic material and colored material may be transferred on to a sheet using the hot stamping technique and pre-designed hot stamp dies to create a feature on the sheet having an optically variable effect as discussed herein. This could then be incorporated in to a document body via a lamination or similar technique. Printing techniques such as gravure printing or screen printing may also be employed. When optically variable features are employed within a card itself, the optically variable effect may be pre-determined for a group of cards, and designed into the etch on a gravure cylinder or the screen for screen printing, as examples. In some embodiments, one metallic layer and one colored semi-transparent pigment layer may be used, with two different corresponding designs used within two different corresponding gravure cylinders or two different corresponding screens. After the optically variable feature is printed, the material containing the feature may be laminated to the body of the document. For example, the feature could be direct gravure printed or screen printed onto a roll or sheet of polycarbonate material. The pre-printed polycarbonate material could then be sandwiched into a full document body. The sandwich of polycarbonate material including the pre-printed optically variable feature may then be laminated using standard plate lamination techniques (e.g., a Burkle press).

In another example, the metallic pigment design may be printed on to one sheet of polymer material (e.g., polycarbonate), and the colored semi-transparent pigment design on a separate sheet of polymer to be used in the same document, with the designs aligned such that when brought together the two designs cooperate to provide the optically variable feature (e.g., the designs are aligned such that all or a portion of the colored semi-transparent pigment design overlays or is on top of at least a portion of the metallic pigment design). Such embodiments provide additional security, as a counterfeiter would need access to both parts of the final design, with the individual parts separately shipped and/or stored to reduce risk of unauthorized use.

Further, in various embodiments, security features within a card or other document body as discussed herein may be used in combination with other security features, such as in conjunction with a holographic feature within a polycarbonate card body. As the features discussed herein, although optically variable, are distinctly different from holographic features and/or features created by use of optically variable pigments, two or more techniques may be used in a complementary fashion.

FIG. 1 provides a flowchart of a method 100 for printing an object (e.g., printing on a target and providing an optically variable effect, such as for a security feature), in accordance with various embodiments. The method 100, for example, may employ or be performed by structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. In various embodiments, portions, aspects, and/or variations of the method 100 may be able to be used as one or more algorithms to direct hardware to perform one or more operations described herein.

At 102, a first image is printed on a target. In the depicted embodiment, the first image is printed with a metallic material. Generally, the metallic material is configured to cooperate with a subsequently applied colored semi-transparent material applied above the metallic material (i.e., the metallic material is interposed between the colored semi-transparent material and the target) to provide an optically variable effect. In various embodiments, the metallic material may be thermally transferred from a dye sheet or thermal transfer sheet. The target, for example, may be a license, card, or identifying document. In various embodiments, the metallic material is a metal flake pigment with a polymeric binder or carrier. For example, in some embodiments the metallic material is a leafing silver pigment as discussed herein. The first image may additionally include one or more of text, a geometric shape, a picture (such as a portrait or photograph of a person), or a descriptive shape or figure (e.g., an outline of a country or other geographic region as it may appear on a map).

Figure 2A:
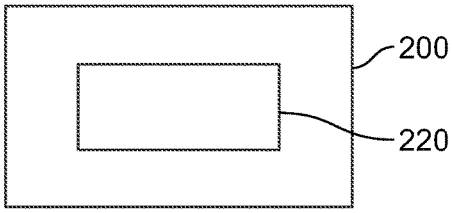
FIG. 2A provides a schematic view of an example document in accordance with various embodiments.
Figure 2B:
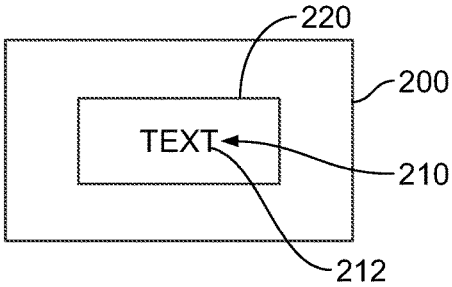
FIG. 2B provides a view of the document of FIG. 2A at a different viewing angle.

For example, at 104, printing the first image includes printing text with the metallic material. For example, one or more of a name, number, or code may be printed with the metallic material as part of printing the first image. The text of the first image in various embodiments cooperates with a subsequently applied material (e.g., a colored semi-transparent material printed on top of the metallic material) to provide an optically variable effect in which the text is not visible at a first viewing angle and is visible at a second viewing angle. For example, FIGS. 2A and 2B depicts an example document 200 including a first image 210 that includes text 212, and a second image 220 (e.g., an image printed with a colored semi-transparent material) represented schematically by a box. At a first viewing angle depicted in FIG. 2A, only the second image 220 is visible. However, at a second viewing angle depicted in FIG. 2B, both the second image 220 and the text 212 of the first image 210 are visible. For example, the text 212 may appear superimposed on top of the second image 220 (even though the first image 210 is below the second image 220). It may be noted that variable shades of text may be provided by varying the amount of metallic material printed within a text outline or footprint.

Figure 2C:
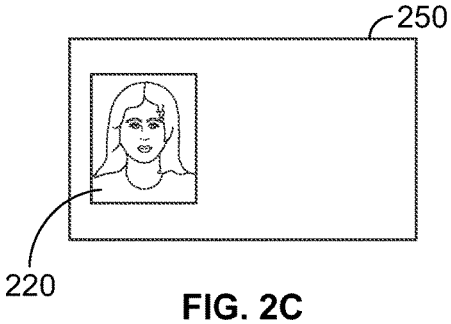
FIG. 2C illustrates an example card observed at a first angle in accordance with various embodiments.
Figure 2D:
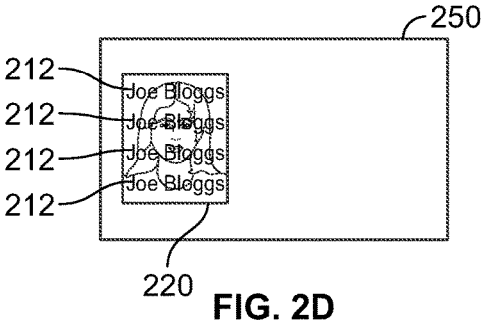
FIG. 2D illustrates the example card of FIG. 2C at a second angle.

FIG. 2C and FIG. 2D illustrate an example card 250 with a second image 220 (in the depicted example, a head and shoulders photograph) and text 212 (in the depicted example, lines of text including "Joe Bloggs"). In FIG. 2C, with the card 250 held at a first angle, the second image 220 is plainly visible, but the text 212 is not visible or hardly visible in various embodiments. In FIG. 2D, with the card at a second angle, both the second image 220 and the text 212 are plainly visible.

Returning to FIG. 1, it may be noted that, additionally or alternatively, the first image may include a non-textual picture or representation. At 106 of the illustrated embodiment, a non-textual image is printed as part of printing the first image. For example, the first image may include a portrait or photograph (e.g., a portrait or photograph of an individual corresponding to an identification document on which the first image is printed). As another example, the first image may include all or a portion of a map. In various embodiments, the first image may be partially or entirely co-extensive with a subsequently applied second image. Further, the first image may be a smaller version of a subsequently applied second image.

It may be noted that, as also discussed elsewhere herein, various techniques may be used to apply or print the first image to the target. For example, in the illustrated embodiment, at 108, the first image is thermally transferred to the target. For example, the metallic material may be transferred to the target from a mass transfer panel from a thermal transfer or dye sheet.

At 110, a clear layer is provided. The clear layer is printed on top of, or above, the first image (i.e., the first image is interposed between the clear layer and the target). The clear layer is interposed between the first image and a subsequently applied second image. In various embodiments, the clear layer is applied using a colorless and transparent material configured to protect the first image and/or improve adhesion between the first image and subsequently applied materials (e.g., a colored semi-transparent material of a second image). A clear layer may also be added underneath the metallic layer (i.e., between the target and the first image layer) to improve adhesion to the target substrate of choice. It may be noted that use of clear layers is not limited to singular use; in various embodiments, multiple clear layers may be used in any combination to obtain required adhesion and transfer properties without compromising the visual effect.

It may be noted that the first image and a subsequently applied second image may be printed to the same target at the same location (e.g., the first image from a first mass transfer panel of a thermal transfer sheet and the second image printed from a second mass transfer panel of the same thermal transfer sheet immediately thereafter), or may be printed at different locations. For example, the first image may be printed as a common image (e.g., the same first image printed to a number of targets) at a first location, with the target then transferred to a second location at which the second image is printed. The second image may be printed as a unique image (e.g., a different second image printed for each of the targets provided with the common first image). The clear layer applied at 110 may be used to protect the first image when the target is being stored and/or in transit, and/or may improve adhesion between the first and second targets.

At 112, a second image is printed to the target over the first image. In the illustrated embodiment, the second image is printed with a colored semi-transparent material. For example, the second image in various embodiments is printed with a sub-micron pigment as discussed herein. Generally, the second image and the first image cooperate to provide an optically variable effect. In some embodiments, the second image is viewable at all angles, and the first image is viewable only at some viewing angles. For example, the first image may appear and disappear as a lighting angle and/or viewing angle is changed. In some embodiments, the first image and the second image may cooperate to change a shade of the second image. For example, the first image may be partially or completely co-extensive with the second image, with the two images providing a combined visible image. As the lighting and/or viewing angle is changed, the contribution of the first image to the combined visible image observed by a viewer may change, thereby changing the shade of the combined visible image.

Figure 3A:
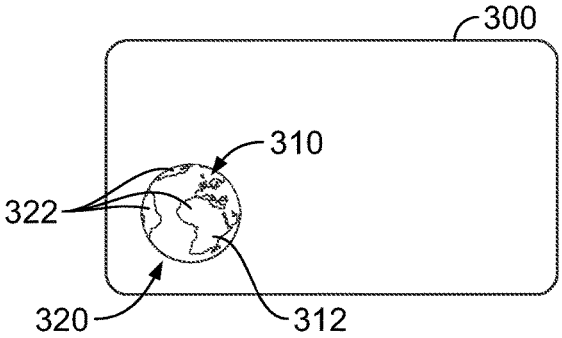
FIG. 3A provides a schematic view of an example document in accordance with various embodiments.
Figure 3B:
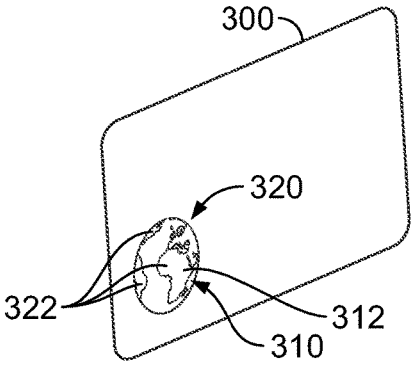
FIG. 3B provides a view of the document of FIG. 3A at a different viewing angle.

For example, FIGS. 3A and 3B depict an example document with a first image 310 and a second image 320. The second image 320 depicts a geographical region 322, such as a map or globe projection that depicts a number of different regions (e.g., states, countries, and/or continents). The first image 310 depicts a geographical region 312 that is a subset of the geographical region 322. For example, the geographical region 312 may correspond to a single country, continent, or state. The first image 310 and the second image 320 may be understood as partially co-extensive, as they have a common boundary or footprint over a portion of the second image 320. For FIG. 3A, at a first viewing angle, the second image 320 has a uniformly shaded appearance (e.g., the first image 310 is not visible or does not contribute to the visible appearance of the document 300, with the entire geographic region 322 appearing the same shade); however, in FIG. 3B, at a different viewing angle, the first image 310 contributes to the overall visible image, resulting in the second image 310 having a different apparent shade for those portions with which the first image 310 is co-extensive. In alternate embodiments, the first image 310 may contribute at different viewing angles. For example, at a first viewing angle, the geographic region 312 may have a lighter appearance than the remainder of the geographic region 322, while, at a second viewing angle, the geographic region 312 may have a darker appearance than the remainder of the geographic region 322. Accordingly, in various embodiments, the first and second image may share a common footprint, with an apparent shade of the second image varying with changes in lighting angle.

Figure 4A:
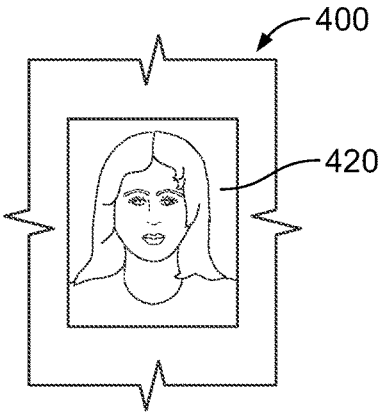
FIG. 4A provides a schematic view of an example document in accordance with various embodiments.
Figure 4B:
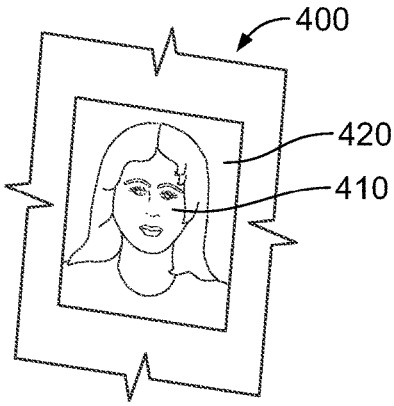
FIG. 4B provides a view of the document of FIG. 4A at a different viewing angle.

As another example, in some embodiments, the first image may be a smaller version of the second image. For example, FIGS. 4A and 4B depict an example document 400 with a first image 410 and a second image 420. Each of the first image 410 and the second image 420 are photographic representations of the same person; however, the first image 410 is a smaller version. In FIG. 4A, at a first viewing angle, only the second image 420 is viewable. In FIG. 4B, at a second viewing angle, the first image 410 is visible. It may be noted that the second image 420 is not shown in FIG. 4B for clarity of illustration; however, in practice the first image 410 may be seen superimposed on the second image 420.

Returning to FIG. 1, it may be noted that, as also discussed elsewhere herein, various techniques may be used to apply or print the second image to the target. For example, in the illustrated embodiment, at 114, the second image is thermally transferred to the target. For example, the colored semi-transparent material may be transferred to the target from a mass transfer panel from a thermal transfer or dye sheet. It may be noted that other printing techniques may be employed in other embodiments.

Figure 5:
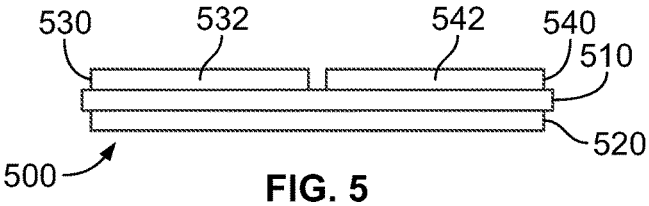
FIG. 5 provides a schematic view of a thermal transfer sheet in accordance with various embodiments.

FIG. 5 provides a schematic view of a thermal transfer sheet 500 in accordance with various embodiments. The thermal transfer sheet 500 may be sized, shaped, and otherwise configured to be compatible with readily available printers, allowing the thermal transfer sheet 500 to be used with existing printers. Generally, the thermal transfer sheet 500 is configured for thermal printing, or the diffusion of dye and/or transfer of material to a target via heating. It may be noted that the particular arrangement of panels or other aspects of the thermal transfer sheet 500 shown in FIG. 5 are by way of example for illustrative purposes, and that other combinations or arrangements of panels or layers may be used in other embodiments (e.g., additional layers or panels added, a panel or layer shown in FIG. 5 removed, panels or layers positioned differently with respect to each other than as shown in FIG. 5). As another example, sheets with a continuous format may be utilized instead of panels in various embodiments. In some embodiments, the target to be printed on may be a card, such as a credit card or identification card or license. In other embodiments, the target may be a re-transferable film that is subsequently applied to another object. The thermal transfer sheet 500 may be used in conjunction with one or more aspects of the method 100.

As seen in FIG. 5, the illustrated thermal transfer sheet 500 includes a substrate 510, a metallic material mass transfer panel 530, and a colored semi-transparent pigment mass transfer panel 540. The metallic mass transfer panel 530 includes a metallic material 532 configured to be thermally transferred from the thermal transfer sheet 500 to a printing target, and the colored pigment mass transfer panel 540 includes a colored semi-transparent material 542 configured to be thermally transferred from the thermal transfer sheet 500 to a printing target. The metallic mass transfer panel 530 and the colored semi-transparent pigment mass transfer panel 540 are positioned on the thermal transfer sheet 500 such that the thermal transfer sheet 500 first prints to the target from the metallic mass transfer panel 530 and next prints to the target from the colored semi-transparent pigment mass transfer panel 540. It may be noted that, in embodiments, where a re-transferable film is printed to as an initial target, with the re-transferable film later applied to a final target, that the colored semi-transparent pigment mass transfer panel 540 may be first printed to the initial target (the re-transferable film), so that an image printed from the metallic mass transfer panel 530 is immediately adjacent to the final target or otherwise interposed between the final target and an image printed with the colored semi-transparent material 542 provided from the colored semi-transparent pigment mass transfer panel 540. It may be noted that other panels may be included on the thermal transfer sheet. For example, dye diffusion panels may be provided. As another example, a black mass transfer panel may be provided (e.g., to provide text not having an optically variable effect). Further still, one or more clear mass transfer panels may be provided (e.g., to provide a clear layer as discussed in connection with step 110 of FIG. 1, and/or to provide a protective top coat after printing of one or more optically variable images is completed). Also, one or more releasing sub-coat layers may be provided interposed between the substrate 510 and one or more corresponding mass transfer panels. As another example, a back-coat 520 may be disposed beneath the substrate 510 (or farther away from a target for printing than the substrate 510). The back coat 520 in the illustrated embodiment is disposed farther away from a target for printing than the substrate 510. The back coat 520, for example, may be configured to aid transport across a thermal print head. Heat from a thermal print head may be transferred through the back coat 520 to the panels 530, 540 and/or dye diffusion panels (not shown in FIG. 5).

In various embodiments, the metallic material 532 may be a metal flake pigment. For example, the metallic material may be a leafing silver pigment. Also, in various embodiments, the colored semi-transparent material 542 is a sub-micron pigment as discussed herein. Generally, the colored semi-transparent material 542 is selected to have sufficient transparency to allow the colored semi-transparent material 542 to cooperate with the metallic material 532 after printing to provide an optically variable effect.

Figure 6:
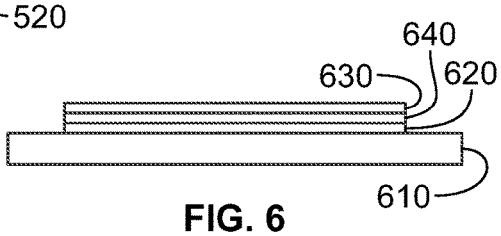
FIG. 6 provides a side schematic view of a document in accordance with various embodiments.
Figure 7:
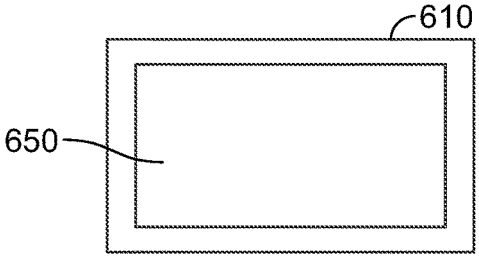
FIG. 7 provides a top view of the document of FIG. 6.

FIG. 6 provides a side schematic view of a document 600 in accordance with various embodiments, and FIG. 7 provides a top view of the document 600. It may be noted that the document 600 may be produced, for example, using dye sheet 500 and/or method 600 discussed herein. It may further be noted that the relative thicknesses of the depicted aspects in FIG. 6 are not to scale but are instead selected for clarity and ease of illustration.

As seen in FIG. 6, the document 600 includes a base 610, a first image 620, and a second image 630. The base 610, for example, may be a blank card or similar structure configured to receive printing.

The first image 620 includes a metallic material. For example, as one example, the first image 620 may be provided by thermal transfer of a metal flake pigment from a thermal transfer sheet as discussed herein. The first image 620 is interposed between the base 610 and the second image 630. The second image 630 includes a colored semi-transparent pigment. The second image 630 and the first image 620 cooperate to provide an optically variable effect as discussed herein. For example, in some embodiments, the second image 630 is viewable at all viewing angles and the first image 620 is viewable only at some viewing angles. In the illustrated embodiment, the document 600 includes a clear layer 640 interposed between the first image and the second image 620. The clear layer 640 in various embodiments provides protection for the first image 620 and/or improves adhesion between the first image 620 and the second image 630.

It may be noted that, in some embodiments, the first image 620 and the second image 630 share a common footprint (e.g., either partially or entirely), with an apparent shade of the second image 630 varies with a change in angle of lighting. (See, e.g., FIGS. 3A and 3B and related discussion.) In some embodiments, however, the first image has a different footprint than the second image 630. For example, the footprint of the first image 620 may be contained entirely within the footprint of the second image 630. Additionally or alternatively, the first image 620 may include text. (See, e.g., FIGS. 2A and 2B and related discussion.)

As seen in FIG. 7, the second image 630 and the first image 620 cooperate at the locations at which they overlap to provide a security feature 650. In various embodiments, the first image 620 (and/or layer including the first image 620) and the second image 630 (and/or layer including the second image 630) cooperate to provide the security feature 650 with an optically variable effect as discussed herein. For example, one of the images may be visible at all viewing angles, while the other image cannot be seen at certain viewing angles but then becomes clearly visible at different viewing angles. For example, one image may be hidden within the other image until the printed article is viewed at the appropriate angle. As mentioned above, it may be noted that for the example illustrated in FIGS. 6 and 7, the second image 630 and first image 620, along with the security feature 650, share a common footprint. However, in other embodiments, the footprint for the second image 630 and the first image 620 may be different, with the security feature 650 provided in areas of overlap between the second image 630 and the first image 620.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It should be noted that the particular arrangement of components (e.g., the number, types, placement, or the like) of the illustrated embodiments may be modified in various alternate embodiments.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, and denotes structural requirements of any structure, limitation, or element that is described as being "configured to" perform the task or operation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, the embodiments are by no means limiting and are exemplary embodiments. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments, including the best mode, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A method comprising:

printing a first image to a target, the first image printed with a metallic material;

printing a second image to the target over the first image, the second image printed with a colored semi-transparent material; and providing a clear layer interposed between the first image and the second image.

2. The method of claim 1, wherein the first image and the second image have a common footprint, wherein an apparent shade of the second image varies with a change in angle of lighting.

3. The method of claim 1, wherein the first image has a different footprint than the second image.

4. The method of claim 3, wherein printing the first image comprises printing text with the metallic material.

5. The method of claim 1, wherein the first image is a smaller version of the second image.

6. The method of claim 1, wherein the metallic material is a metal flake pigment.

7. The method of claim 6, wherein the metallic material is a leafing metallic pigment.

8. The method of claim 1, wherein the colored semi-transparent material is a sub-micron pigment.

9. The method of claim 1, wherein printing the first image comprises thermally transferring the metallic material to the target, and printing the second image comprises thermally transferring the colored semi-transparent material to the target.

10. The method of claim 1, wherein the first image is printed at a first location as a common image, and the second image is printed at a second location as a unique image.

11. A document comprising:

a base;

a first image printed on the base, the first image comprising a metallic material;

a second image printed on the base, the first image interposed between the base and the second image, the second image comprising a colored semi-transparent pigment; and a clear layer interposed between the first image and the second image.

12. The document of claim 11, wherein the first image and the second image have a common footprint, wherein an apparent shade of the second image varies with a change in angle of lighting.

13. The document of claim 12, wherein the first image has a different footprint than the second image.

14. The document of claim 12, wherein the first image comprises text.

15. A document having a feature comprising:

a first layer comprising a metallic material;

a second layer comprising a colored semi-transparent material; and a clear layer interposed between the first layer and the second layer;

wherein the first and second layer cooperate to provide an optically variable effect.

16. The feature of claim 15, wherein the metallic material and colored semi-transparent material are disposed on the document via thermal transfer.

17. The feature of claim 15, wherein the optically variable effect includes a change in visible shade of a color of the security feature when a viewing angle is changed.

18. The feature of claim 15, wherein a first image is visible at a first viewing angle, and a different, second image is visible at a second viewing angle.

19. The feature of claim 15, wherein the metallic material and colored semi-transparent material are disposed on the document via at least one of gravure printing, coating, screen printing, or hot stamping.

20. The feature of claim 15, wherein the metallic material and colored semi-transparent material are included within the body of a document via lamination.

* * * * *